US011572090B2

(12) United States Patent
Nakanishi et al.

(10) Patent No.: US 11,572,090 B2
(45) Date of Patent: Feb. 7, 2023

(54) HEADWAY CONTROL DEVICE

(71) Applicant: Mitsubishi Electric Corporation, Tokyo (JP)

(72) Inventors: Akira Nakanishi, Tokyo (JP); Takaya Katsuragi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 291 days.

(21) Appl. No.: 17/053,863

(22) PCT Filed: Jun. 21, 2018

(86) PCT No.: PCT/JP2018/023684
§ 371 (c)(1),
(2) Date: Nov. 9, 2020

(87) PCT Pub. No.: WO2019/244307
PCT Pub. Date: Dec. 26, 2019

(65) Prior Publication Data

US 2021/0129883 A1 May 6, 2021

(51) Int. Cl.
*B61L 27/10* (2022.01)

(52) U.S. Cl.
CPC ..... *B61L 27/10* (2022.01)

(58) Field of Classification Search
None
See application file for complete search history.

(56) References Cited

U.S. PATENT DOCUMENTS 7,428,452 B2 * 9/2008 Howlett ..... B61L 27/12 701/19
9,764,747 B2 * 9/2017 Egler ..... B61L 3/006
(Continued)

FOREIGN PATENT DOCUMENTS

EP 3078565 A1 10/2016
JP 2014233988 A * 12/2014 ..... B60L 15/40
(Continued)

OTHER PUBLICATIONS

Office Action dated Dec. 8, 2021, issued in corresponding Indian Patent Application No. 202027049327, 6 pages.
(Continued)

*Primary Examiner* — Adam D Tissot
(74) *Attorney, Agent, or Firm* — Buchanan Ingersoll & Rooney PC

(57) ABSTRACT

A headway control device includes: a delay time receiving unit that receives identification information and a delay time of each train within a control range; a target traveling time calculating unit that identifies a train to be controlled on the basis of the delay time, determines an order in which trains travel in a traveling direction by using the identification information, identifies a preceding train and a following train on the basis of the order, and calculates a target traveling time of the train to be controlled in a travel section in which the train to be controlled travels next by using a normal traveling time, the delay time of the train to be controlled, the delay time of the preceding train, and the delay time of the following train; and a target traveling time transmitting unit that transmits the target traveling time to the train to be controlled.

9 Claims, 6 Drawing Sheets

(56) References Cited

U.S. PATENT DOCUMENTS

| | | | | |
|---|---|---|---|---|
| 2015/0360705 | A1 | 12/2015 | Niinomi et al. | |
| 2016/0267391 | A1* | 9/2016 | Cogill | G06N 20/00 |
| 2019/0318253 | A1* | 10/2019 | Maekawa | G06F 30/20 |

FOREIGN PATENT DOCUMENTS

| | | | | | |
|---|---|---|---|---|---|
| JP | 2014233988 | A | | 12/2014 | |
| JP | 2015107687 | A | * | 6/2015 | B61L 27/0027 |
| JP | 2015107687 | A | | 6/2015 | |
| JP | 2017043265 | A | | 3/2017 | |

OTHER PUBLICATIONS

International Search Report (PCT/ISA/210), with translation, and Written Opinion (PCT/ISA/237) dated Sep. 18, 2018, by the Japan Patent Office as the International Searching Authority for International Application No. PCT/JP2018/023684.

* cited by examiner

HEADWAY CONTROL DEVICE

FIELD

The present invention relates to a headway control device and a headway control method for controlling train headway.

BACKGROUND

In related art, when a train is delayed from a train schedule, traffic control of trains includes controlling the traveling time, the departure time at a station, and the like of the delayed train so as to reduce or prevent decrease in passenger transport efficiency. Patent Literature 1 teaches a technology of a traffic control device calculating delay times of a train to be controlled, a train preceding the train to be controlled, and a train following the train to be controlled on the basis of a train schedule, position information of each train, and the like, and restricting traveling of the train to be controlled such as stopping the train to be controlled from leaving a station or lowering the traveling speed of the train to be controlled to reduce or prevent decrease in passenger transport efficiency. Because a longer headway between specific trains lowers the passenger transport efficiency, the traffic control device described in Patent Literature 1 restricts traveling of the train to be controlled in view of the delay times of the preceding train and the following train.

CITATION LIST

Patent Literature

Patent Literature 1: Japanese Patent Application Laid-open No. 2017-043265

SUMMARY

Technical Problem

The control performed by the traffic control device described in Patent Literature 1, however, can reduce or prevent decrease in the passenger transport efficiency but has a problem in that the delay from the train schedule cannot be recovered.

The present invention has been made in view of the above, and an object thereof is to provide a headway control device capable of recovering a delay from a train schedule while reducing or preventing decrease in passenger transport efficiency when a train is delayed.

Solution to Problem

A headway control device according to an aspect of the present invention includes a delay time receiving unit that receives identification information and a delay time of each train within a control range. The headway control device also includes a target traveling time calculating unit that identifies a train to be controlled being a train to be subjected to travel control on the basis of the delay time, determines an order in which trains travel in a traveling direction by using the identification information of each of the trains, identifies a preceding train being a train traveling ahead of the train to be controlled and a following train being a train traveling behind the train to be controlled on the basis of the order, and calculates a target traveling time of the train to be controlled in a travel section in which the train to be controlled travels next by using a normal traveling time set for normal traveling in the travel section, the delay time of the train to be controlled, the delay time of the preceding train, and the delay time of the following train. The headway control device also includes a target traveling time transmitting unit that transmits the target traveling time to the train to be controlled.

Advantageous Effects of Invention

According to the present invention, the headway control device produces an effect of recovering a delay from a train schedule while reducing or preventing decrease in passenger transport efficiency when a train is delayed.

DESCRIPTION OF EMBODIMENTS

A headway control device and a headway control method according to certain embodiments of the present invention will be described in detail below with reference to the drawings. Note that the present invention is not limited to the embodiments.

First Embodiment

Figure 1:
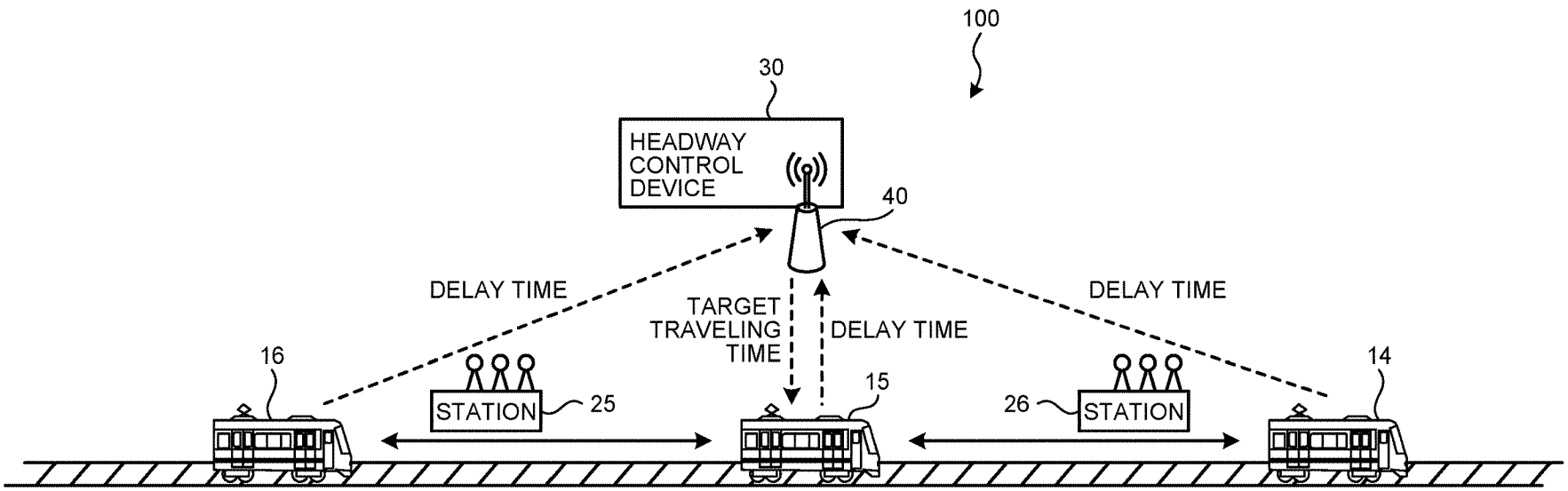
FIG. 1 is a diagram illustrating an example of a configuration of a traffic control system according to a first embodiment.

FIG. 1 is a diagram illustrating an example of a configuration of a traffic control system 100 according to a first embodiment of the present invention. The traffic control system 100 includes trains 14, 15, and 16, a headway control device 30, and a radio base station 40.

The trains 14 to 16 each include an on-board device and an automatic train operation (ATO), which are not illustrated. The on-board device generates a run-curve indicating the relation between the position and a target speed of the subject train on which the on-board device is mounted on the basis of set traveling times between stations. The ATO controls the traveling of the subject train in accordance with the generated run-curve. The trains 14 to 16 each measures a delay time at departure from a station each time the trains 14 to 16 leave a station, and transmits identification information and the delay time to the headway control device 30.

The identification information is a train number set to be used during operation of each train. Even trains having the same train car composition have different train identification information, that is, different train numbers from each other when the trains are operated in different time periods from each other. A delay time is a time difference between a departure time set in a train schedule and an actual departure time at a station that each train having a train number has left. A delay time may be a time difference between a passage time set for normal operation and an actual passage time when a train has passed a specific point, such as a specific wayside coil. Even when no delay has occurred, the trains 14 to 16 each set a delay time of 0, and transmit the identification information and the delay time. In FIG. 1, the direction from left to right in the drawing will be referred to as the traveling direction of the trains 14 to 16. While only two stations 25 and 26 are illustrated in FIG. 1, one or more stations are assumed to be actually present to the left of the station 25 and to the right of the station 26.

The radio base station 40 is installed on the ground, and relays communication between the trains 14 to 16 and the headway control device 30. The communication between the radio base station 40 and the headway control device 30 may be radio communication or cable communication. The communication between the radio base station 40 and the trains 14 to 16 is radio communication; however, other existing communication schemes such as communication using pickup coils, which are not illustrated, installed on the trains 14 to 16 and wayside coils installed on the ground, may be used.

When any of the trains 14 to 16 within a control range of the headway control device 30 is delayed, the headway control device 30 performs control to restore the operation to that according to the train schedule while reducing or preventing decrease in passenger transport efficiency. In the first embodiment, the headway control device 30 is equipment installed on the ground. The headway control device 30 may be installed in a base device or the like, which is not illustrated, or may be installed as independent equipment, for example.

Figure 2:
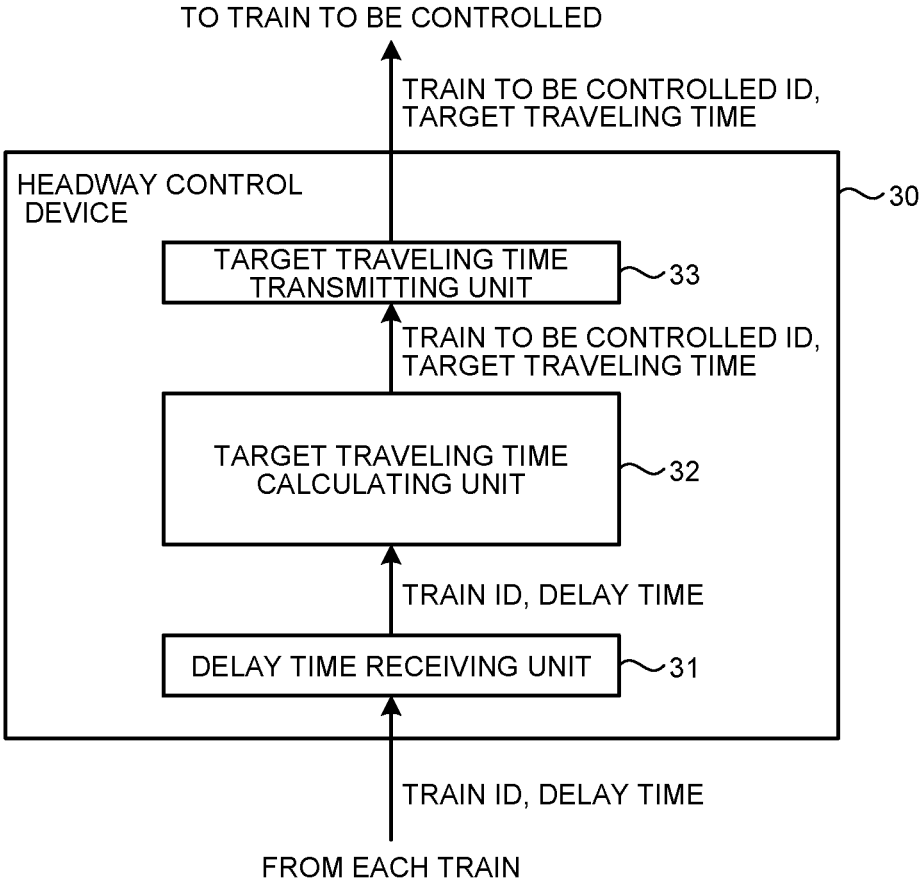
FIG. 2 is a block diagram illustrating an example of a configuration of a headway control device according to the first embodiment.

A configuration of the headway control device 30 will be described. FIG. 2 is a block diagram illustrating an example of the configuration of the headway control device 30 according to the first embodiment. The headway control device 30 includes a delay time receiving unit 31, a target traveling time calculating unit 32, and a target traveling time transmitting unit 33.

The delay time receiving unit 31 receives identification information and a delay time of each train within the control range of the headway control device 30 from the trains within the control range via the radio base station 40. In FIG. 2, identification information is referred to as a train ID (identification). The delay time receiving unit 31 outputs the received identification information and delay times to target traveling time calculating unit 32. Note that the delay time receiving unit 31 may hold the received identification information and delay time. In this case, upon receiving the identification information and a delay time transmitted from each train at departure from a next station, the delay time receiving unit 31 updates the held delay time. In the case of holding the delay times of the respective trains, the delay time receiving unit 31 holds 0 indicating that no delay has occurred as initial values.

The target traveling time calculating unit 32 determines a train to be controlled that is a train to be subjected to travel control on the basis of the delay times of the respective trains. When a delay time of a train is equal to or longer than a preset threshold, for example, the target traveling time calculating unit 32 determines that this train is delayed, and determines this train as a train to be controlled. In the example of FIG. 1, the target traveling time calculating unit 32 determines the train 15 as a train to be controlled. The target traveling time calculating unit 32 determines the order in which the trains travel in the traveling direction of these trains by using pieces of the identification information of these trains. Because the identification information, that is, the train numbers are set in advance in the train schedule, the target traveling time calculating unit 32 can recognize the preceding and following relations of the trains, that is, the order in which the trains travel in the traveling direction on the basis of the train numbers. The target traveling time calculating unit 32 identifies a preceding train, which is a train traveling ahead of the train to be controlled, and a following train, which is a train traveling behind the train to be controlled, on the basis of the determined order. In the example of FIG. 1, the target traveling time calculating unit 32 identifies the train 14 as the preceding train, and the train 16 as the following train. The target traveling time calculating unit 32 calculates a target traveling time in a travel section in which the train to be controlled travels next by using a normal traveling time set for normal traveling in the travel section, the delay time of the train to be controlled, the delay time of the preceding train, and the delay time of the following train. In other words, the target traveling time calculating unit 32 calculates the target traveling time by using the normal traveling time and the delay times of the three trains. The travel section is a section between a first stop at which the train to be controlled is stopped and a second stop at which the train to be controlled stops next. The normal traveling time is an inter-station traveling time set for normal traveling between the first stop and the second stop. Details of a method for calculating the target traveling time by the target traveling time calculating unit 32 will be described later. The target traveling time calculating unit 32 outputs the calculated target traveling time together with the identification information of the train to be controlled to the target traveling time transmitting unit 33.

The target traveling time transmitting unit 33 transmits the target traveling time calculated by the target traveling time calculating unit 32 to the train to be controlled via the radio base station 40 by using the identification information of the train to be controlled. The target traveling time transmitting unit 33 may transmit the target traveling time at preset intervals, or each time the target traveling time is obtained from the target traveling time calculating unit 32. Note that the target traveling time transmitting unit 33 may hold the identification information and the target traveling time obtained from the target traveling time calculating unit 32. In this case, upon obtaining a next target traveling time for the train to be controlled having the same identification information from the target traveling time calculating unit 32, the target traveling time transmitting unit 33 updates the held target traveling time.

Figure 3:
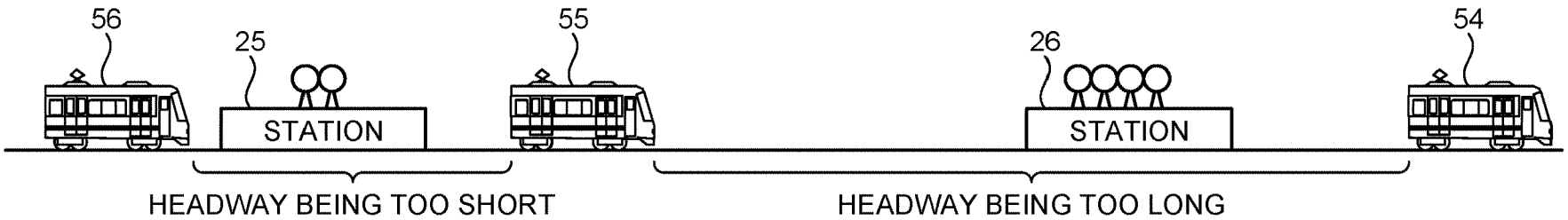
FIG. 3 is a diagram illustrating a change in the number of passengers when travel control of a train is not performed in the case where the train is delayed.

A change in passenger transport efficiency in a case where a train is delayed will now be explained. FIG. 3 is a diagram illustrating a change in the number of passengers when travel control of a train is not performed in the case where the train is delayed. FIG. 3 illustrates an example in which only the delayed train is delayed and neither of the preceding train and the following train are not delayed. Typically, the train schedule is set so that the intervals between trains, that is, the headways are not significantly different between successive headways in normal operation state based on the train schedule in which no delay has occurred. This is because a significant difference between headways causes the degrees of crowdedness significantly different among trains, which increases the time for passengers to get on and off a train with more passengers and makes the train likely to delay. In a case where only a delayed train 55 is delayed and a preceding train 54 and a following train 56 are not delayed as illustrated in FIG. 3, the headway between the preceding train 54 and the delayed train 55 becomes too long, which increases the number of passengers waiting at the station 26 as compared with that before the train delay. In the meantime, the headway between the following train 56 and the delayed train 55 becomes too short, which decreases the number of passengers waiting at the station 25 as compared with that before the train delay. Upon arriving at the station 26, the delayed train 55 needs to allow many passengers to get on, which increases the time for passengers to get on and off, further increases the delay, and the train schedule becomes further disrupted. In such a case, delaying the preceding train 54 can shorten the headway between the preceding train 54 and the delayed train 55, and thus can reduce or prevent the train schedule from becoming further disrupted. At the same time, this also delays the preceding train 54 that could operate normally, which can disrupt the train schedule of trains in a wide range.

Thus, in the first embodiment, when a train within the control range is delayed, the headway control device 30 performs travel control of the delayed train so as to restore the train schedule while reducing or preventing the decrease in passenger transport efficiency.

In the first embodiment, the target traveling time calculating unit 32 of the headway control device 30 actually determines one or more trains traveling within the control range of the headway control device 30 as trains to be controlled, and calculates the target traveling times of the trains to be controlled. While only the trains 14 to 16 are illustrated in FIG. 1, it is assumed that a train 13, which is not illustrated, is present to the right of the train 14, and that a train 17, which is not illustrated, is present to the left of the train 16. In this case, when the train 14 is delayed, the target traveling time calculating unit 32 can determine the train 14 as a train to be controlled, the train 13 as a preceding train, and the train 15 as a following train, and calculate the target traveling time of the train to be controlled, that is, the train 14. In addition, when the train 16 is delayed, the target traveling time calculating unit 32 can determine the train 16 as a train to be controlled, the train 15 as a preceding train, and the train 17 as a following train, and calculate the target traveling time of the train to be controlled, that is, the train 16. When no preceding train is present, the target traveling time calculating unit 32 may set the delay time of the preceding train to 0. For example, no preceding train is present for an operation start train that is the first train. In addition, when no following train is present, the target traveling time calculating unit 32 may set the delay time of the following train to 0. For example, no following train is present for an operation end train that is the last train. Thus, each train can be a train to be controlled, a preceding train, and a following train. The method for calculating the target traveling time of a train to be controlled by the target traveling time calculating unit 32 is, however, the same for any combination of a train to be controlled, a preceding train, and a following train. Thus, an example of a case where a train to be controlled is the train 15, a preceding train is the train 14, and a following train is the train 16 as illustrated in FIG. 1 will be described below.

Figure 4:
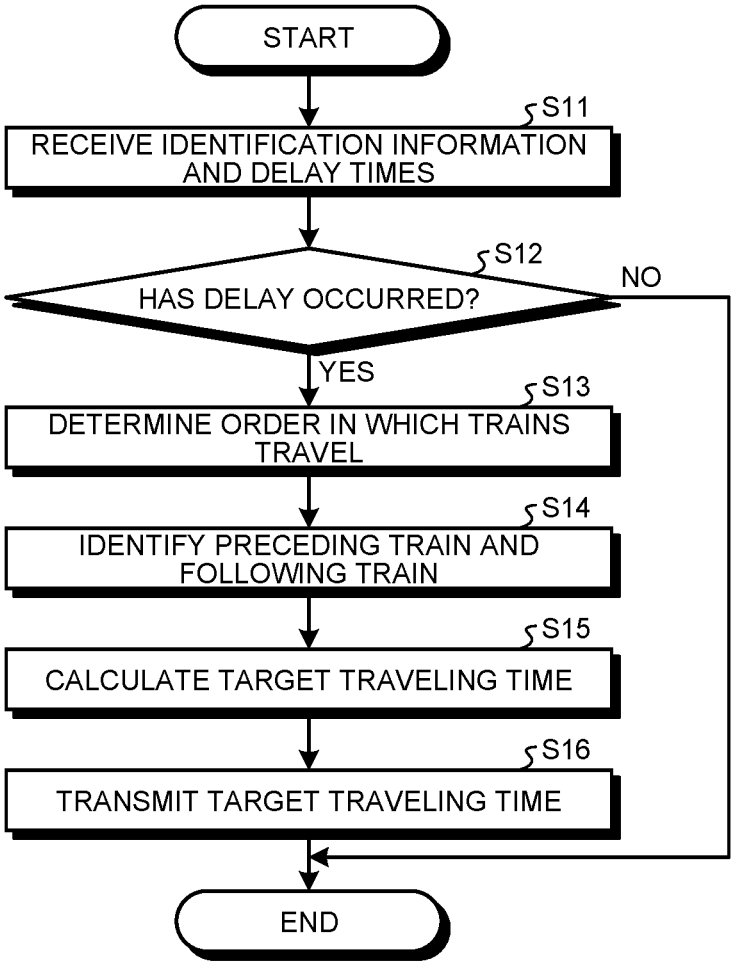
FIG. 4 is a flowchart illustrating operation of the headway control device according to the first embodiment for performing travel control on a train to be controlled that is delayed.

Specific operation of the headway control device 30 will be explained. FIG. 4 is a flowchart illustrating operations of the headway control device 30 according to the first embodiment for performing travel control on a train to be controlled that is delayed. In the headway control device 30, the delay time receiving unit 31 receives the identification information and a delay time from each of the trains 14 to 16 within the control range of the headway control device 30 via the radio base station 40 (step S11). The delay time receiving unit 31 outputs the received identification information and delay times to target traveling time calculating unit 32.

The target traveling time calculating unit 32 determines whether or not a delay has occurred to the trains 14 to 16 within the control range on the basis of the identification information and the delay times obtained from the delay time receiving unit 31 (step S12). As described above, when a delay time is equal to or longer than a preset threshold, the target traveling time calculating unit 32 determines that a delay has occurred. The target traveling time calculating unit 32 permits a delay time shorter than the threshold. If it is determined that no train is delayed (step S12: No), the target traveling time calculating unit 32 terminates the processing. If it is determined that there is a train that is delayed (step S12: Yes), the target traveling time calculating unit 32 determines the train determined as being delayed as a train to be controlled subjected to travel control. In the example of FIG. 1, the target traveling time calculating unit 32 determines that the train 15 is delayed, and determines the train 15 as a train to be controlled.

The target traveling time calculating unit 32 determines the order in which the train travel in the traveling direction of the trains by using the identification information of each train (step S13). As illustrated in FIG. 1, the target traveling time calculating unit 32 determines that the train 14, the train 15, and the train 16 are traveling in this order in the traveling direction. The target traveling time calculating unit 32 identifies a preceding train traveling ahead of the train to be controlled, that is, the train 15, and a following train traveling behind the train to be controlled, that is, the train 15 on the basis of the determined order (step S14). As illustrated in FIG. 1, the target traveling time calculating unit 32 identifies the train 14 as the preceding train and the train 16 as the following train.

The target traveling time calculating unit 32 calculates the target traveling time in a travel section in which the train to be controlled, that is, the train 15 travels next by using formula (1) and formula (2) (step S15).

$$t_{c(i),s(j)}=t_{tmp}(t_{tmp}\geq tr_{s(j)})=tr_{s(j)}(t_{tmp}<tr_{s(j)}) \quad (1)$$

$$t_{tmp}=tn_{s(j)}-dt_{c(i),s(j)}+k\times\max(dt_{c(i-1),(s+j)},dt_{c(i+1),s(j-1)}) \quad (2)$$

In the formula (1) and the formula (2), c(i) represents a train, and i indicates the order in which trains travel. A smaller value of i indicates a train ahead in the traveling direction. When c(i) represents the train to be controlled (the train 15), c(i−1) represents the preceding train (the train 14), and c(i+1) represents the following train (the train 16). In addition, s(j) represents a station, and j indicates the arrangement of stations. A smaller value of j indicates a station located backward in the traveling direction. $t_{tmp}$ represents a target traveling time that is necessary for calculation by the target traveling time calculating unit 32. $t_{c(i),s(j)}$ represents a target traveling time of the train represented by c(i), that is, the train to be controlled between a station s(j) and a station s(j+1). $tn_{s(j)}$ represents a normal traveling time between the station s(j) and the station s(j+1) in normal operation set in the train schedule. $tr_{s(j)}$ represents the fastest traveling time set between the station s(j) and the station s(j+1). The target traveling time $t_{c(j),s(j)}$ and the normal traveling time $tn_{s(j)}$ are equal to or longer than the fastest traveling time $tr_{s(j)}$. $dt_{c(i),s(j)}$ represents a delay time that has occurred at departure of the train represented by c(i) from the station represented by s(j). k represents a weighting factor used on a delay time of an adjacent train for calculation of the target traveling time. Note that 0<k<1 is satisfied. The third term of the formula (2) is an image of a geometric progression with a common ratio k where the range 0<k<1, and is assumed to converge to 0 by update of the target traveling time using the formula (2) each time train to be controlled leaves a station. k may be a fixed value or may be obtained by the target traveling time calculating unit 32 by computation using the delay times of the train to be controlled, the preceding train, and the following train or the like.

As expressed by a first line of the formula (1), when the target traveling time $t_{tmp}$ necessary for calculation is longer than the fastest traveling time $tr_{s(j)}$, the target traveling time calculating unit 32 uses the target traveling time $t_{c(i),s(j)}$ as the target traveling time $t_{tmp}$ necessary for calculation. In contrast, as expressed by the second line of the formula (1), when the target traveling time $t_{tmp}$ necessary for calculation is shorter than the fastest traveling time $tr_{s(j)}$, the target traveling time calculating unit 32 uses the target traveling time $t_{c(i),s(j)}$ as the fastest traveling time $tr_{s(j)}$ because the target traveling time $t_{c(i),s(j)}$ cannot be shorter than the fastest traveling time $tr_{s(j)}$.

As expressed by the formula (2), the target traveling time calculating unit 32 calculates the target traveling time $t_{tmp}$ necessary for calculation by subtracting the delay time $dt_{c(i),s(j)}$ of the train to be controlled from the normal traveling time $tn_{s(j)}$ in normal operation, and adding a value obtained by multiplying a delay time max ($dt_{c(i-1),(s+j)}$, $dt_{c(i+1),s(j-1)}$), which is the larger one of the delay time ($dt_{c(i-1),(s+j)}$, of the preceding train and the delay time $dt_{c(i+1),s(j-1)}$ of the following train, by the weighting factor. The target traveling time calculating unit 32 can calculate a target traveling time $t_{c(i),s(j)}$ prolonged depending on the delay time of the preceding train or the following train by using the formula (1) and the formula (2) as described above while recovering the delay of the train to be controlled to reduce or prevent the delay from increasing.

The target traveling time calculating unit 32 outputs the identification information of the train to be controlled whose target traveling time is calculated and the calculated target traveling time to the target traveling time transmitting unit 33. The target traveling time transmitting unit 33 transmits the target traveling time calculated by the target traveling time calculating unit 32 to the train to be controlled, that is, the train 15 via the radio base station 40 by using the identification information of the train to be controlled (step S16).

The train to be controlled, that is, the train 15 that has obtained the target traveling time generates a run-curve by using the target traveling time, and travels in accordance with the run-curve.

While the target traveling time calculating unit 32 uses the weighting factor k in the third term on the delay times of the preceding train and the following train in the formula (2), a weighting factor may also be used in the second term on the delay time of the train to be controlled. A formula using a weighting factor in the second term is expressed by formula (3).

$$t_{tmp}=tn_{s(j)}-1\times dt_{c(i),s(j)}+k\times\max(dt_{c(i-1),(s+j)},\ dt_{c(i+1),s(j-1)}) \quad (3)$$

In the formula (3), 1 represents a weighting factor on the delay time of the train to be controlled. The target traveling time calculating unit 32 obtains 1 by computation from a ratio of the delay time $dt_{c(i),s(j)}$ of the train to be controlled to the traveling time $tn_{s(j)}$, for example. 1 may be referred to as a first weighting factor, and k may be referred to as a second weighting factor. As expressed by the formula (3), the target traveling time calculating unit 32 calculates the target traveling time $t_{tmp}$ necessary for calculation by subtracting a value obtained by multiplying the delay time $dt_{c(i),s(j)}$ of the train to be controlled by the first weighting factor from the normal traveling time $tn_{s(j)}$ in normal operation, and adding a value obtained by multiplying the second weighting factor by a delay time max ($dt_{c(i-1),(s+j)}$, $dt_{c(i+1),s(j-1)}$), which is the larger one of the delay time $dt_{c(i-j),(s+j)}$ of the preceding train and the delay time $dt_{c(i+1),s(j-1)}$ of the following train. The target traveling time calculating unit 32 can calculate a target traveling time $t_{c(i),s(j)}$ prolonged depending on the delay time of the preceding train or the following train by using the formula (1) and the formula (3) as described above while recovering the delay of the train to be controlled to reduce or prevent the delay from increasing.

Next, a hardware configuration of the headway control device 30 will be described. In the headway control device 30, the delay time receiving unit 31 and the target traveling time transmitting unit 33 are communication devices. The target traveling time calculating unit 32 is implemented by processing circuitry. The processing circuitry may be constituted by a processor that executes programs stored in a memory and the memory, or may be dedicated hardware.

Figure 5:
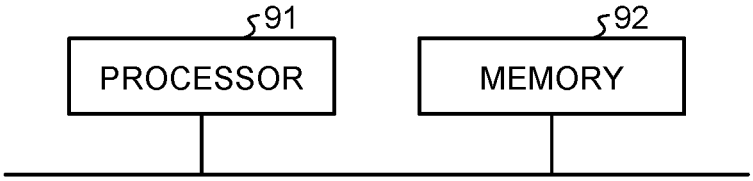
FIG. 5 is a diagram illustrating an example of a case where processing circuitry included in the headway control device according to the first embodiment is constituted by a processor and a memory.

FIG. 5 is a diagram illustrating an example of a case where the processing circuitry included in the headway control device 30 according to the first embodiment is implemented by a processor and a memory. In the case where the processing circuitry is constituted by a processor 91 and a memory 92, the functions of the processing circuitry of the headway control device 30 are implemented by software, firmware, or a combination of software and firmware. The software or firmware is described in the form of programs and stored in the memory 92. The processing circuitry implements the functions by reading and executing the programs stored in the memory 92 by the processor 91. Specifically, the processing circuitry includes the memory 92 for storing programs that results in execution of processes of the headway control device 30. In other words, these programs cause a computer to execute the procedures and the methods of the headway control device 30.

Note that the processor 91 may be a central processing unit (CPU), a processing device, a computing device, a microprocessor, a microcomputer, a digital signal processor (DSP), or the like. In addition, the memory 92 is a nonvolatile or volatile semiconductor memory such as a random access memory (RAM), a read only memory (ROM), a flash memory, an erasable programmable ROM (EPROM), or an electrically erasable programmable ROM (EEPROM: registered trademark), a magnetic disk, a flexible disk, an optical disk, a compact disc, a mini disc, a digital versatile disc (DVD) or the like, for example.

Figure 6:
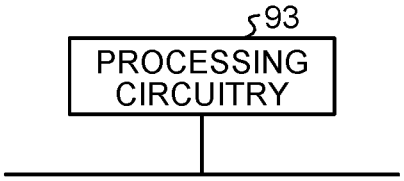
FIG. 6 is a diagram illustrating an example of a case where processing circuitry included in the headway control device according to the first embodiment is constituted by dedicated hardware.

FIG. 6 is a diagram illustrating an example of a case where the processing circuitry included in the headway control device 30 according to the first embodiment is constituted by dedicated hardware. In the case where the processing circuitry is constituted by dedicated hardware, the processing circuitry 93 illustrated in FIG. 6 is a single circuit, a composite circuit, a programmed processor, a parallel-programmed processor, an application specific integrated circuit (ASIC), a field programmable gate array (FPGA), or a combination thereof, for example. The functions of the headway control device 30 may be implemented separately by the processing circuitry 93, or may be implemented collectively by the processing circuitry 93.

Note that some of the functions of the headway control device 30 may be implemented by dedicated hardware, and others may be implemented by software or firmware. As described above, the processing circuitry is capable of implementing the above-described functions by dedicated hardware, software, firmware, or a combination thereof.

As described above, according to the present embodiment, in the headway control device 30, the target traveling time calculating unit 32 calculates a target traveling time in a travel section in which the train to be controlled that is delayed and that is subjected to travel control travels next by using the normal traveling time set for normal traveling in the travel section of the train to be controlled, the delay time of the train to be controlled, the delay time of the preceding train, and the delay time of the following train. As a result, when a train is delayed, the headway control device 30 can recover the delay from the train schedule while reducing or preventing decrease in passenger transport efficiency. In addition, the headway control device 30 can avoid a state in which trains are continuous close to each other by changing the traveling speed of the train to be controlled in a travel section, which can also contribute to energy-saving operation of trains when a delay has occurred.

Second Embodiment

In the first embodiment, the case where the headway control device 30 is installed on the ground has been described. In a second embodiment, each train includes a headway control device 30 mounted thereon. The differences from the first embodiment will be described.

Figure 7:
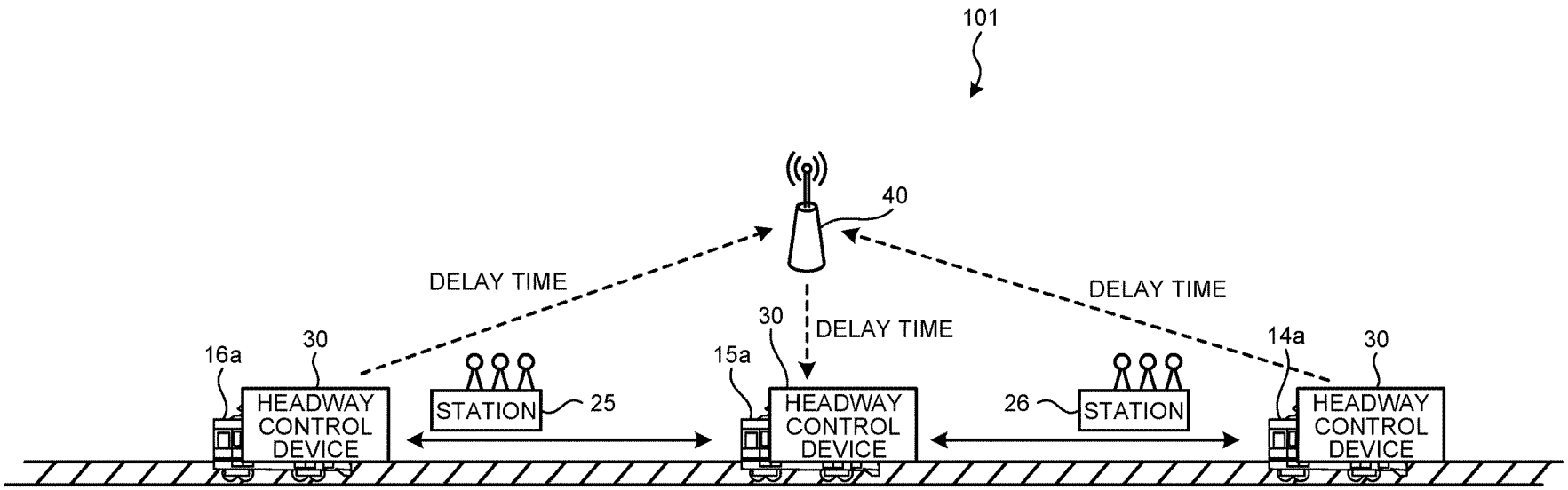
FIG. 7 is a diagram illustrating an example of a configuration of a traffic control system according to a second embodiment.

FIG. 7 is a diagram illustrating an example of a configuration of a traffic control system 101 according to the second embodiment. The traffic control system 101 incudes trains 14*a*, 15*a*, and 16*a*, and a radio base station 40. The trains 14*a* to 16*a* each further include a headway control device 30 in addition to the configurations of the trains 14 to 16 in the first embodiment illustrated in FIG. 1. A headway control device 30 is mounted on each train.

In the second embodiment, the delay time receiving unit 31 of each headway control device 30 receives identification information and delay times from trains other than the train on which the present headway control device 30 is mounted via the radio base station 40 installed on the ground. The delay time receiving unit 31 receives the identification information and a delay time from the train on which the present headway control device 30 is mounted by cable communication or radio communication. Thus, in a manner similar to the first embodiment, the delay time receiving unit 31 receives identification information and a delay time of each train within the control range of the headway control device 30 from the trains within the control range.

In the second embodiment, the target traveling time calculating unit 32 of each headway control device 30 calculates the target traveling time in a manner similar to the first embodiment. Note that the target traveling time calculating unit 32, however, determines the train on which the present headway control device 30 is mounted as the train to be controlled, and calculates the target traveling time of the train to be controlled. Thus, in the second embodiment, the target traveling time calculating unit 32 calculates only the target traveling time of one train. When the delay time of the train on which the present headway control device 30 is mounted is equal to or longer than a preset threshold, for example, the target traveling time calculating unit 32 determines that the train on which the present headway control device 30 is mounted is delayed, and determines the train on which the present headway control device 30 is mounted as a train to be controlled that is a train subjected to travel control. The target traveling time calculating unit 32 determines the order in which the respective trains travel in the traveling direction of the trains by using the identification information of the respective trains. The target traveling time calculating unit 32 identifies a preceding train, which is a train traveling ahead of the train to be controlled, and a following train, which is a train traveling behind the train to be controlled, on the basis of the determined order. In a case where the train 15*a* is a train to be controlled in the example of FIG. 7, the target traveling time calculating unit 32 identifies the train 14*a* as the preceding train and the train 16*a* as the following train. The target traveling time calculating unit 32 calculates a target traveling time in a travel section in which the train to be controlled travels next by using a normal traveling time set for normal traveling in the travel section, the delay time of the train to be controlled, the delay time of the preceding train, and the delay time of the following train. In other words, the target traveling time calculating unit 32 calculates the target traveling time by using the normal traveling time and the delay times of the three trains. The method for calculating the target traveling time by the target traveling time calculating unit 32 is as described above. The target traveling time calculating unit 32 outputs the calculated target traveling time together with the identification information of the train to be controlled to the target traveling time transmitting unit 33.

In the second embodiment, the target traveling time transmitting unit 33 of each headway control device 30 transmits the target traveling time to the train on which the present headway control device 30 is mounted by cable communication or radio communication.

As described above, according to the present embodiment, the target traveling time calculating unit 32 in each headway control device 30 calculates only the target traveling time of one train on which the present headway control device 30 is mounted. Thus, in each train, the target traveling time of the subject train is calculated. As a result, the processing load on the headway control device 30 in calculating the target traveling time can be reduced as compared with the first embodiment.

The configurations presented in the embodiments above are examples of the present invention, and can be combined with other known technologies or can be partly omitted or modified without departing from the scope of the present invention.

REFERENCE SIGNS LIST

14 to 16 train; 25, 26 station; 30 headway control device; 31 delay time receiving unit; 32 target traveling time calculating unit; 33 target traveling time transmitting unit; 40 radio base station; 100, 101 traffic control system.

The invention claimed is:

1. A headway control device comprising:

processing circuitry to receive identification information and a delay time of each train within a control range;

to identify a train to be controlled being a train to be subjected to travel control on the basis of the delay time, determine an order in which trains travel in a traveling direction by using the identification information of each of the trains, identify a preceding train being a train traveling ahead of the train to be controlled and a following train being a train traveling behind the train to be controlled on the basis of the order, and calculate a target traveling time of the train to be controlled in a travel section in which the train to be controlled travels next by using a normal traveling time set for normal traveling in the travel section, the delay time of the train to be controlled, the delay time of the preceding train, and the delay time of the following train; and to transmit the target traveling time to the train to be controlled, wherein the processing circuitry calculates the target traveling time by subtracting the delay time of the train to be controlled from the normal traveling time, and adding a value obtained by multiplying a weighting factor by a larger one of: the delay time of the preceding train and the delay time of the following train.

2. A headway control device mounted on a train, the headway control device comprising:

processing circuitry to receive identification information and a delay time of each train within a control range;

to determine the train on which the headway control device is mounted as a train to be controlled being a train to be subjected to travel control, determine an order in which trains travel in a traveling direction by using the identification information of each of the trains, identify a preceding train being a train traveling ahead of the train to be controlled and a following train being a train traveling behind the train to be controlled on the basis of the order, and calculate a target traveling time of the train to be controlled in a travel section in which the train to be controlled travels next by using a normal traveling time set for normal traveling in the travel section, the delay time of the train to be controlled, the delay time of the preceding train, and the delay time of the following train; and to transmit the target traveling time to the train to be controlled, wherein the processing circuitry calculates the target traveling time by subtracting the delay time of the train to be controlled from the normal traveling time, and adding a value obtained by multiplying a weighting factor by a lamer one of: the delay time of the preceding train and the delay time of the following train.

3. A headway control device comprising:

processing circuitry to receive identification information and a delay time of each train within a control range;

to identify a train to be controlled being a train to be subjected to travel control on the basis of the delay time, determine an order in which trains travel in a traveling direction by using the identification information of each of the trains, identify a preceding train being a train traveling ahead of the train to be controlled and a following train being a train traveling behind the train to be controlled on the basis of the order, and calculate a target traveling time of the train to be controlled in a travel section in which the train to be controlled travels next by using a normal traveling time set for normal traveling in the travel section, the delay time of the train to be controlled, the delay time of the preceding train, and the delay time of the following train; and to transmit the target traveling time to the train to be controlled, wherein the processing circuitry calculates the target traveling time by subtracting, from the normal traveling time, a value obtained by multiplying the delay time of the train to be controlled by a first weighting factor, and adding a value obtained by multiplying a second weighting factor by a larger one of: the delay time of the preceding train and the delay time of the following train.

4. The headway control device according to claim 1, wherein the travel section is a section between a first stop at which the train to be controlled is stopped and a second stop at which the train to be controlled stops next, and the normal traveling time is an inter-station traveling time set for normal traveling between the first stop and the second stop.

5. The headway control device according to claim 1, wherein the delay time is a time difference between a departure time set in a train schedule and an actual departure time at a last station that each train has left.

6. The headway control device according to claim 2, wherein the travel section is a section between a first stop at which the train to be controlled is stopped and a second stop at which the train to be controlled stops next, and the normal traveling time is an inter-station traveling time set for normal traveling between the first stop and the second stop.

7. The headway control device according to claim 3, wherein the travel section is a section between a first stop at which the train to be controlled is stopped and a second stop at which the train to be controlled stops next, and the normal traveling time is an inter-station traveling time set for normal traveling between the first stop and the second stop.

8. The headway control device according to claim 2, wherein the delay time is a time difference between a departure time set in a train schedule and an actual departure time at a last station that each train has left.

9. The headway control device according to claim 3, wherein the delay time is a time difference between a departure time set in a train schedule and an actual departure time at a last station that each train has left.

* * * * *